US009651902B2

(12) United States Patent
Yamano

(10) Patent No.: US 9,651,902 B2
(45) Date of Patent: May 16, 2017

(54) IMAGE FORMING APPARATUS, IMAGE FORMING METHOD, AND STORAGE MEDIUM

(71) Applicant: CANON KABUSHIKI KAISHA, Tokyo (JP)

(72) Inventor: Mikio Yamano, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/542,425

(22) Filed: Nov. 14, 2014

(65) Prior Publication Data

US 2015/0139677 A1 May 21, 2015

(30) Foreign Application Priority Data

Nov. 20, 2013 (JP) ..... 2013-240033
Jul. 24, 2014 (JP) ..... 2014-151197

(51) Int. Cl.
*G03G 15/20* (2006.01)
*G03G 15/00* (2006.01)

(52) U.S. Cl.
CPC ..... *G03G 15/2039* (2013.01); *G03G 15/2046* (2013.01); *G03G 15/5025* (2013.01)

(58) Field of Classification Search
CPC ..... G03G 15/2039; G03G 15/2042; G03G 15/205; G03G 15/2046
See application file for complete search history.

(56) References Cited

U.S. PATENT DOCUMENTS

| | | | | |
|---|---|---|---|---|
| 5,109,255 | A * | 4/1992 | Nishikawa et al. | 399/70 |
| 2012/0250094 | A1* | 10/2012 | Matsuda | 358/1.17 |
| 2013/0084092 | A1* | 4/2013 | Ooyanagi | 399/69 |
| 2013/0209120 | A1* | 8/2013 | Namekata et al. | 399/67 |

FOREIGN PATENT DOCUMENTS

| | | | |
|---|---|---|---|
| CN | 103376686 | A | 10/2013 |
| EP | 2657791 | A2 | 10/2013 |
| GB | 2239109 | A | 6/1991 |
| JP | 59-088770 | A | 5/1984 |
| JP | H11-125986 | A | 5/1999 |
| JP | 2013-076953 | A | 4/2013 |

OTHER PUBLICATIONS

Machine translation of Kamijo JP 11125986 A, publication date: May 11, 1999.*
Translation of Kamijo (JP 11125986 A) listed in the IDS, publication date: May 11, 1999.*

* cited by examiner

*Primary Examiner* — Walter L Lindsay, Jr.
*Assistant Examiner* — Frederick Wenderoth
(74) *Attorney, Agent, or Firm* — Canon U.S.A., Inc., IP Division

(57) ABSTRACT

There is provided an image forming apparatus including a fixing unit in which fixing temperature is calculated from a toner bearing amount and fixing processing is performed while reducing drop in the print speed. A method for controlling a temperature of a fixing unit for fixing a recording material onto a recording medium includes determining, for image data of a plurality of pages, whether a data size of the image data of a unit page is smaller than or equal to a predetermined threshold, and based on the determination result, selecting whether to control the temperature of the fixing unit to be a temperature determined from the amount of the recording material of the image data of the unit page, or to control the temperature of the fixing unit to be a predetermined temperature.

25 Claims, 19 Drawing Sheets

FIG. 4

| TONER BEARING AMOUNT | FIXING TEMPERATURE |
|---|---|
| 200% | T1 |
| 175% | T2 |
| 150% | T3 |
| 125% | T4 |
| 100% | T5 |

FIG. 8A
FIG. 8
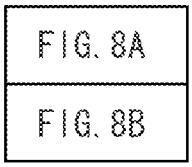
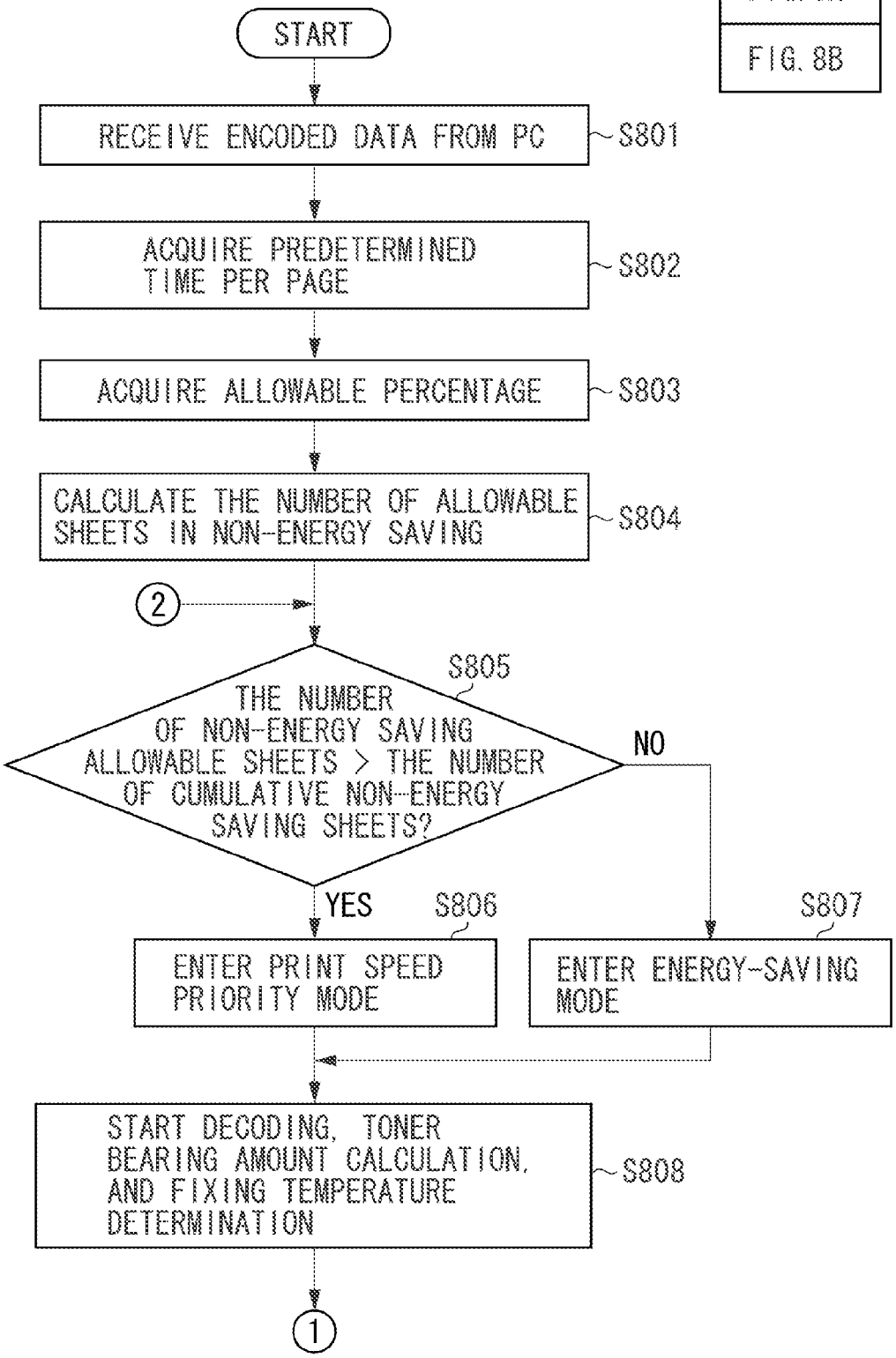

| |
|---|
| FIG. 9A |
| FIG. 9B |

FIG. 13

| | PREDETERMINED TIME PER PAGE | PREDETERMINED TIME PER 1/2 PAGE |
|---|---|---|
| NEXT PAGE OF PAGE PROCESSED TO 1/2 PAGE | 1.2 SECONDS | 0.6 SECONDS |
| PAGES OTHER THAN ABOVE PAGE | 0.8 SECONDS | 0.4 SECONDS |

FIG. 15

| PREDETERMINED TIME PER PAGE | THRESHOLD OF ENCODED DATA SIZE |
|---|---|
| 1.2 SECONDS | 15 MEGABYTES |
| 0.8 SECONDS | 10 MEGABYTES |

FIG. 17

| PREDETERMINED TIME PER PAGE | THE NUMBER OF SPOOLS | THRESHOLD OF ENCODED DATA SIZE |
|---|---|---|
| 0.8 SECONDS | 0 | 10 MEGABYTES |
| | 1 | 20 MEGABYTES |
| | 2 | 30 MEGABYTES |
| 1.2 SECONDS | 0 | 15 MEGABYTES |
| | 1 | 30 MEGABYTES |
| | 2 | 45 MEGABYTES |

IMAGE FORMING APPARATUS, IMAGE FORMING METHOD, AND STORAGE MEDIUM

BACKGROUND OF THE INVENTION

Field of the Invention

The present invention relates to an image forming apparatus, an image forming method, and a storage medium for controlling temperature of a fixing unit for fixing a recording material onto a recording medium.

Description of the Related Art

In an image forming apparatus for thermally fixing a toner image formed by an electrophotographic method onto a recording paper, techniques for determining a fixing temperature in a fixing device according to an amount of a recording material (hereinafter, referred to as toner bearing amount) per unit area to be applied on a recording paper have been known. For example, Japanese Patent Application Laid-Open No. 2013-76953 discusses a technique for reducing power consumption to be required in an image forming apparatus by adjusting a fixing temperature of a fixing device according to a toner bearing amount.

In the technique discussed in Japanese Patent Application Laid-Open No. 2013-76953, according to a toner bearing amount calculated based on image data, a fixing temperature is determined to adjust the fixing temperature for recording. Therefore, increase in the time required for the toner bearing amount calculation causes delay in print start of each page, and results in decrease in the print speed of the image forming apparatus. On the other hand, when a constant fixing temperature is applied to any of image data without calculating the toner bearing amount, image data requiring a small toner bearing amount is to be fixed at the fixing temperature that is higher than necessary. This causes increase in power consumption.

SUMMARY OF THE INVENTION

According to an aspect of the present invention, an image forming apparatus configured to control a temperature of a fixing unit for fixing a recording material onto a recording medium, includes a determination unit configured to determine, for image data of a plurality of pages, whether a time required for image processing of the image data of a unit page has exceeded a predetermined time, and a selection unit configured to select, according to a number of pages of the image data that has exceeded the predetermined time, whether to control the temperature of the fixing unit to be a temperature determined from an amount of the recording material of the image data, or to control the temperature of the fixing unit to be a predetermined temperature.

According to the present invention, temperature control in a fixing unit in an image forming apparatus can be performed, while print speed reduction is suppressed.

Further features of the present invention will become apparent from the following description of exemplary embodiments with reference to the attached drawings.

BRIEF DESCRIPTION OF THE DRAWINGS

FIG. 4 is a table illustrating a relationship between a toner bearing amount and a fixing temperature according the first exemplary embodiment of the present invention.

FIG. 13 is a table illustrating a predetermined time for each processing according to the fifth exemplary embodiment of the present invention.

FIG. 15 illustrates a predetermined time for each processing according to the sixth exemplary embodiment of the present invention.

FIG. 17 is a table illustrating a predetermined time for each processing according to the seventh exemplary embodiment of the present invention.

DESCRIPTION OF THE EMBODIMENTS

Various exemplary embodiments, features, and aspects of the invention will be described in detail below with reference to the drawings.

Figure 1:
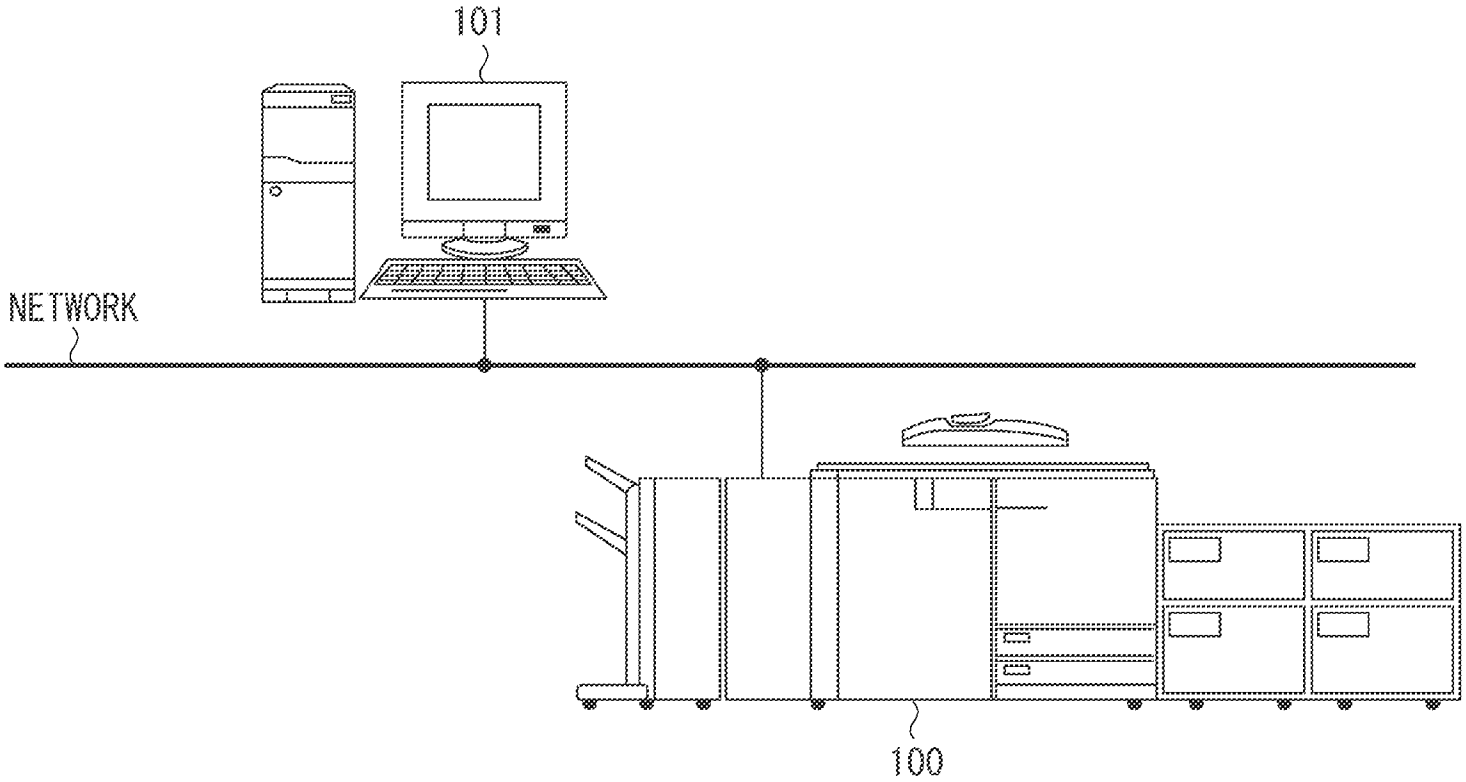
FIG. 1 is a block diagram illustrating a configuration of a system including an image forming apparatus according to a first exemplary embodiment of the present invention.

A first exemplary embodiment of the present invention is described. FIG. 1 is a block diagram illustrating a configuration of a system including an image forming apparatus 100 according to the present exemplary embodiment of the present invention. The image forming apparatus 100 is connected with a client personal computer (PC) 101 via a network. The image forming apparatus 100 processes various types of input data received from the client PC 101, performs image formation, and outputs a print product. The client PC 101 encodes Cyan Magenta Yellow Black (CMYK) image data to reduce transfer time and sends the data to the image forming apparatus.

Figure 2:
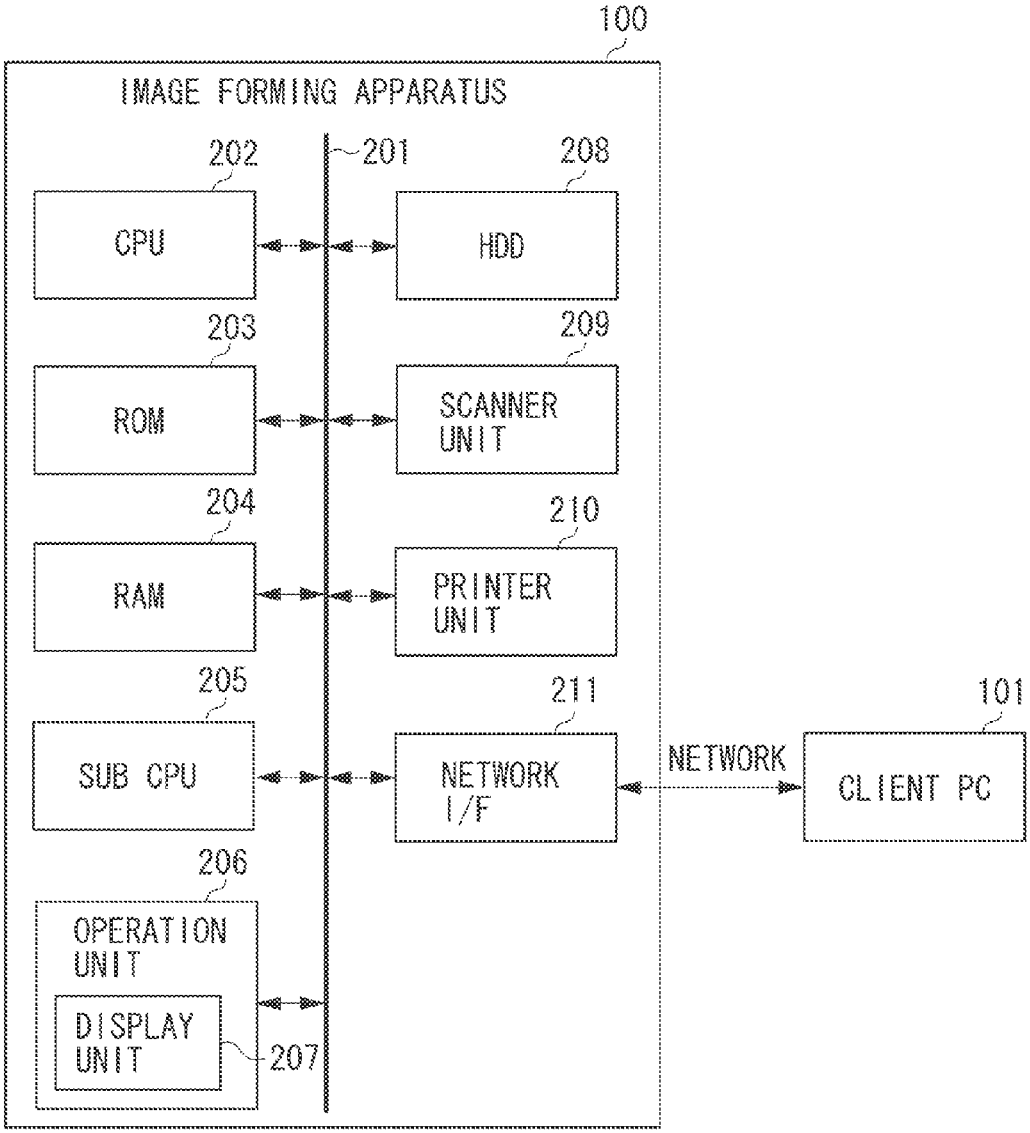
FIG. 2 is a block diagram illustrating the image forming apparatus according to the first exemplary embodiment of the present invention.

FIG. 2 is a block diagram illustrating a configuration of the image forming apparatus 100 according to the present exemplary embodiment. The transmission of signals between individual blocks is performed via a system bus 201. A central processing unit (CPU) 202 and sub CPU 205 each read a control program stored in a read-only memory (ROM) 203, and executes various types of control processes such as print control. A random access memory (RAM) 204 serves as a temporary region for a memory, a work area, or the like of the CPU 202 and the sub CPU 205. The sub CPU 205 decodes the encoded data sent from the client PC 101 via the network and a network interface (I/F) 211, and performs calculation of a toner bearing amount and determination of a fixing temperature. An operation unit 206 includes a display unit 207. Information input via the operation unit 206 is sent to the CPU 202, and the CPU 202 performs desired processing. With the processing, the information is displayed on the display unit 207 in the operation unit 206. A hard disk drive (HDD) 208 can store a large amount of image data for a long time. Image data of a document read by a scanner unit 209 is used, for example, in printing, storage, and transfer. The image data to be printed with a printer unit 210 is sent to the printer unit 210, and printed onto a sheet by the printer unit 210. The network I/F 211 sends or receives image data and various kinds of information to/from the client PC 101 or other devices, via the network.

Figure 3:
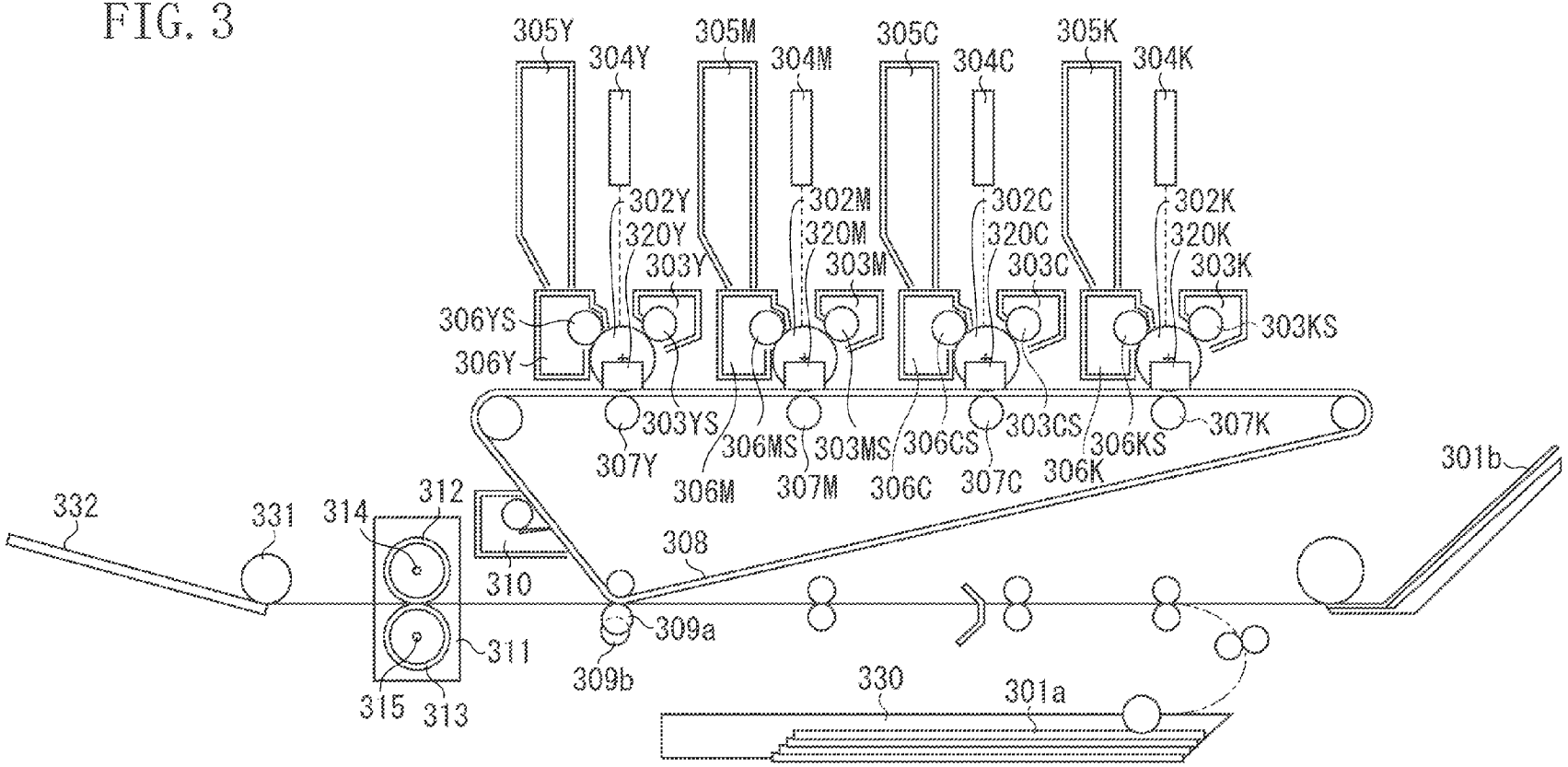
FIG. 3 is a block diagram illustrating a printer unit according to the first exemplary embodiment of the present invention.

FIG. 3 illustrates a configuration of the printer unit 210. The printer unit 210 employs a tandem method using an intermediate transfer member 308. With reference to FIG. 3, image forming operation in the image forming apparatus 100 is described.

Charging means includes four injection chargers 303Y, 303M, 303C, and 303K for the colors of Y, M, C, and K for charging photosensitive members 302Y, 302M, 302C, and 302K, respectively. The injection chargers include sleeves 303YS, 303MS, 303CS, and 303KS, respectively.

The photosensitive members 302Y, 302M, 302C, and 302K are rotated by the driving forces transmitted from drive motors 320Y, 320M, 320C, and 320K, respectively. The drive motors 320Y, 320M, 320C, and 320K respectively rotate the photosensitive members 302Y, 302M, 302C, and 302K in the counterclockwise direction according to the image formation operation.

An exposure unit emits light from illumination units 304Y, 304M, 304C, and 304K toward the photosensitive members 302Y, 302M, 302C, and 302K to selectively exposure the surface of the photosensitive members 302Y, 302M, 302C, and 302K to form electrostatic latent images.

Development means includes, in order to visualize the electrostatic latent image, four development devices 306Y, 306M, 306C, and 306K for performing development of four colors of Y, M, C, and K, respectively. The development devices include sleeves 306YS, 306MS, 306CS, and 306KS, respectively. Each of the development devices 306Y, 306M, 306C, and 306K is detachable.

Transfer means, to transfer a unicolor toner image onto the intermediate transfer member 308 from each of the photosensitive members 302Y, 302M, 302 C, and 302K, rotates the intermediate transfer member 308 in the clockwise direction. The unicolor toner images are respectively transferred with the rotation of the photosensitive members 302Y, 302M, 302C, and 302K and primary transfer rollers 307Y, 307M, 307C, and 307K disposed to face the photosensitive members. While an appropriate bias voltage is applied to each of the primary transfer rollers 307Y, 307M, 307C, and 307K, different rotation speeds are given to the photosensitive members 302Y, 302M, 302C, and 302K and the intermediate transfer member 308 to efficiently transfer the unicolor toner images onto the intermediate transfer member 308. This process is called primary transfer.

The transfer means superimposes the unicolor images onto the intermediate transfer member 308 for each station, and conveys the superimposed multicolor toner image to a secondary transfer roller 309 with the rotation of the intermediate transfer member 308. A recording medium 330 is fed from a sheet feed tray 301*a* or a sheet feed tray 301*b*, and conveyed to the secondary transfer roller 309 by rollers disposed on the conveyance path. The multicolor toner image on the intermediate transfer member 308 is transferred onto the recording medium 330 that is nipped and conveyed to the secondary transfer roller 309. In the secondary transfer, the toner image on the intermediate transfer member 308 is electrostatically transferred by applying an appropriate bias voltage to the secondary roller 309. The secondary transfer roller 309 is brought into contact with the recording medium 330 at a position 309*a* while the multicolor toner image is being transferred onto the recording medium 330, moves to a position 309*b* after the print processing, and separates from the intermediate transfer member 308.

A fixing device (fixing unit) 311 includes a fixing roller 312 for heating the recording medium 330 to fuse the multicolor toner image transferred onto the recording medium 330 and fix the image onto the recording medium 330, and a pressure roller 313 for presses the recording medium 330 to cause the recording medium 330 to contact with a fixing roller 312. The fixing roller 312 and the pressure roller 313 are formed in a hollow state, and include heaters 314 and 315 therein, respectively. The fixing device 311 conveys the recording medium 330 holding the multicolor toner image by the fixing roller 312 and the pressure roller 313, and applies heat and pressure to fix the toner onto the recording medium 330. To the fixing device 311, a temperature sensor (not illustrated) is attached so that the fixing operation is controlled to start after a temperature suitable for the fixation is confirmed. The recording medium 330 after the toner image fixation processing is discharged onto a discharge tray 332 by a discharge roller 331, and the image forming operation ends.

A cleaning unit 310 performs cleaning of the toner remaining on the intermediate transfer member 308. The waste toner, which is remaining after the transfer operation of the four-color multicolor toner image formed on the intermediate transfer member 308 onto the recording medium 330, is stored in a cleaner container.

Next, a toner bearing amount calculation method in the image forming apparatus 100 according to the present exemplary embodiment is described. In the present exemplary embodiment, the toner bearing amount means an amount of toner (amount of a recording material) per unit area, and the unit is expressed as a percentage. For example, if a unit area is defined as one pixel, and a maximum value of each color of C, M, Y, and K is 100%, when two colors of the maximum values are superimposed, it is defined that the pixel has a toner bearing amount of 200%. Image data that has gradations in color, the individual colors can have a value between 0 to 100%. For example, a maximum toner bearing amount of image data that fully uses toner of four colors of C, M, Y, and K in a full-color print mode is a total amount of the four colors, and consequently, the amount is large. On the other hand, a maximum toner bearing amount of a monochrome image of the color K is small because only one color is used. A maximum value in the page is stored as final toner bearing amount information of the page.

Figure 5:
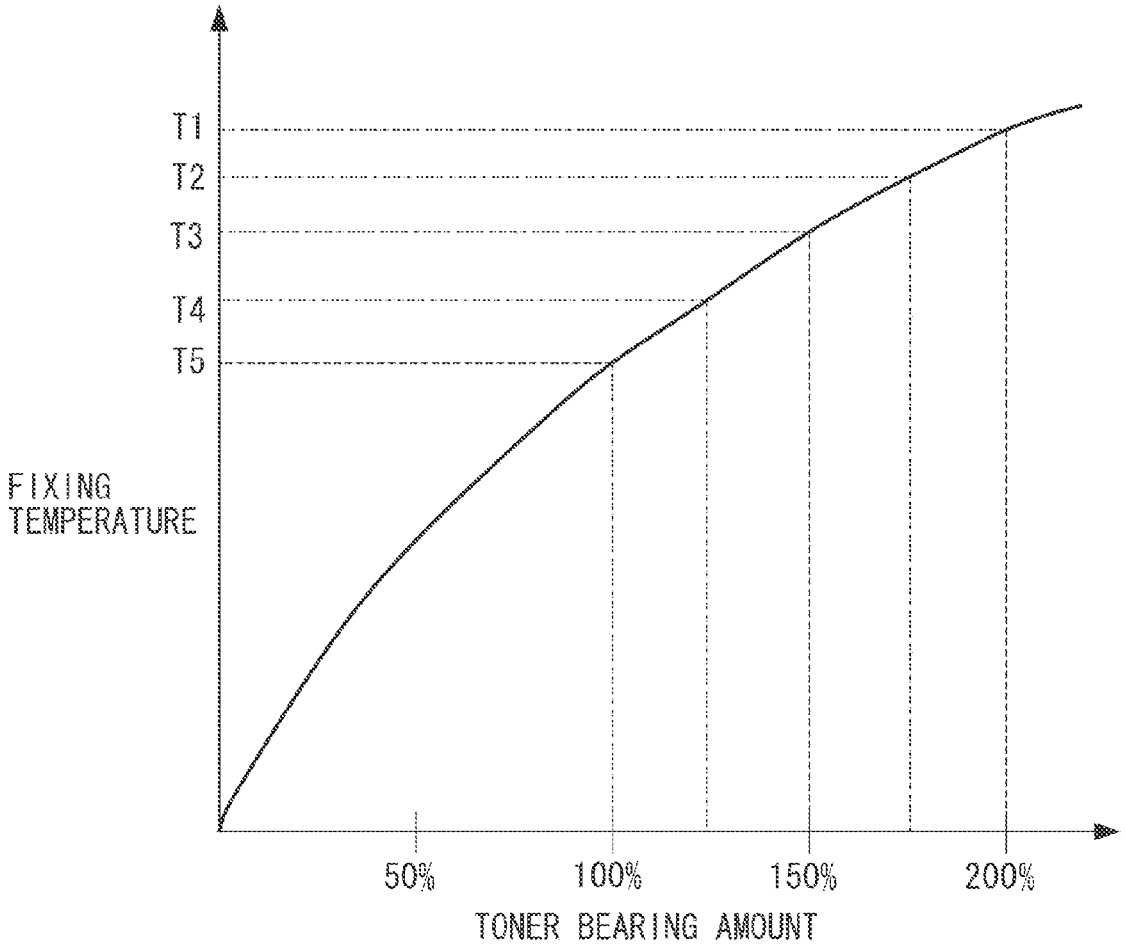
FIG. 5 is a graph illustrating a relationship between a toner bearing amount and a fixing temperature according the first exemplary embodiment of the present invention.

With reference to FIGS. 4 and 5, a method for determining a temperature of the fixing unit required for the fixation of image data to be printed out in the image forming apparatus 100 according to the present exemplary embodiment is described. As described above, the toner bearing amount means an amount of toner per unit area on an image. To fix the toner without fixation failure, the temperature of the fixing device is to be set to a temperature at which the fixation at a maximum value of the toner bearing amount in a target page can be surely performed. Since the maximum toner bearing amount varies according to image data to be printed, the fixing temperature varies according to the individual image data, and consequently, the fixing temperature is set to a higher value as the maximum toner bearing amount becomes larger. Therefore, as illustrated in FIG. 4, the fixing temperature increases in the order of T5, T4, T3, T2, and T1.

FIG. 5 is a graph illustrating a relationship between a toner bearing amount and a fixing temperature of the image forming apparatus 100 according to the present exemplary embodiment. The horizontal axis represents a toner bearing amount, and the vertical axis represents a fixing temperature. For example, when a toner bearing amount information of a target image indicates 200%, the fixing temperature is set to T1, and when the information indicates 100%, the fixing temperature is set to T5. In the present exemplary embodiment, a relationship between the toner bearing amounts and the fixing temperatures illustrated in FIG. 4 is stored in the RAM 204 as a look-up table, or the like in advance, and a fixing temperature corresponding to a toner bearing amount is determined according to a calculated toner bearing amount by referring to the table.

Figure 6:
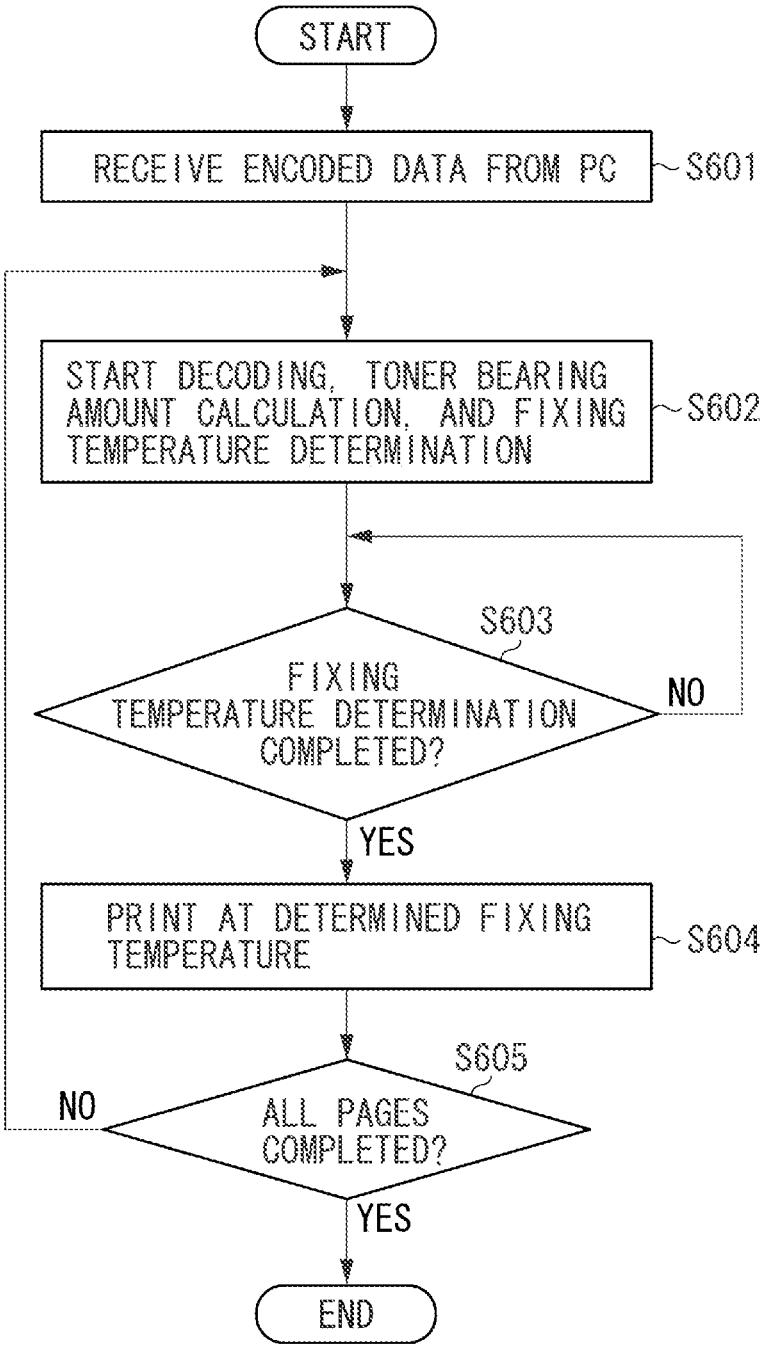
FIG. 6 is a flowchart illustrating a control flow in an energy-saving mode according to the first exemplary embodiment of the present invention.

With reference to FIG. 6, a control flow in an energy-saving mode in the image forming apparatus 100 according to the present exemplary embodiment is described. FIG. 6 illustrates a control flow in the energy-saving mode. In step S601, the CPU 202 receives encoded data of a CMYK image from the client PC 101 via the network and the network I/F 211, and writes the data in the RAM 204. The encoded data received in step S601 includes encoded data of one page or a plurality of pages. In step S602, the sub CPU 205 starts decoding the encoded data of the CMYK image written in the RAM 204, calculating (acquiring) a toner bearing amount, and determining a fixing temperature. In step S603, when the sub CPU 205 completes the processing to the determination of a fixing temperature (YES in step S603), the processing proceeds to step S604. In step S604, the sub CPU 205 sends the fixing temperature determined in step S603 to the printer unit 210, and the printer unit 210 executes the fixation and print processing at the fixing temperature received from the sub CPU 205. In step S605, if the processing of all pages has been completed (YES in step S605), the processing ends, and if not (NO in step S605), the processing proceeds to step S602.

As described above, in the energy-saving mode, for all pages, a toner bearing amount is calculated from image data of each page, and determines a fixing temperature. Therefore, as compared to the case in which the fixing processing is performed at a fixing temperature at which the toner of a maximum toner bearing amount can always be fixed without referring to the toner bearing amount of the image data, the power to be consumed by heaters 314 and 315 of the fixing device 311 can be reduced to a minimum.

In the present exemplary embodiment, in the sub CPU 205, the decoding of the CMYK image, the calculation of the toner bearing amount, and the determination of the fixing temperature are performed. Alternatively, the processing can be performed using the CPU 202 or a dedicated circuit. The image read by the scanner unit 209 can be converted into CMYK image data by the CPU 202, and then, the toner bearing amount calculation and the fixing temperature determination can be performed by the sub CPU 205.

A second exemplary embodiment of the present invention is described. In the first exemplary embodiment, for all pages, the image forming apparatus 100 calculates a toner bearing amount from image data of each page, and performs the fixation at a fixing temperature corresponding to the calculated toner bearing amount to reduce the power consumption to a minimum. However, the processing time necessary for decoding the encoded CMYK image data received from the client PC 101 by the sub CPU 205 depends on the contents of the encoded CMYK image data, and the processing time is not always constant. Moreover, the processing time necessary for calculating a toner bearing amount also varies depending on the number of pixels per area. Therefore, in the sub CPU 205, increase in the time necessary for decoding and calculating the toner bearing amount increases the time necessary from the start of the decoding in the sub CPU 205 and transmission of a fixing temperature to the printer unit 210 to the setting of the temperature of the fixing device 311. This causes decrease in the print speed by the image forming apparatus 100. In the present exemplary embodiment, a print speed priority mode for reducing power consumption as much as possible while maintaining a print speed is described.

Figure 7:
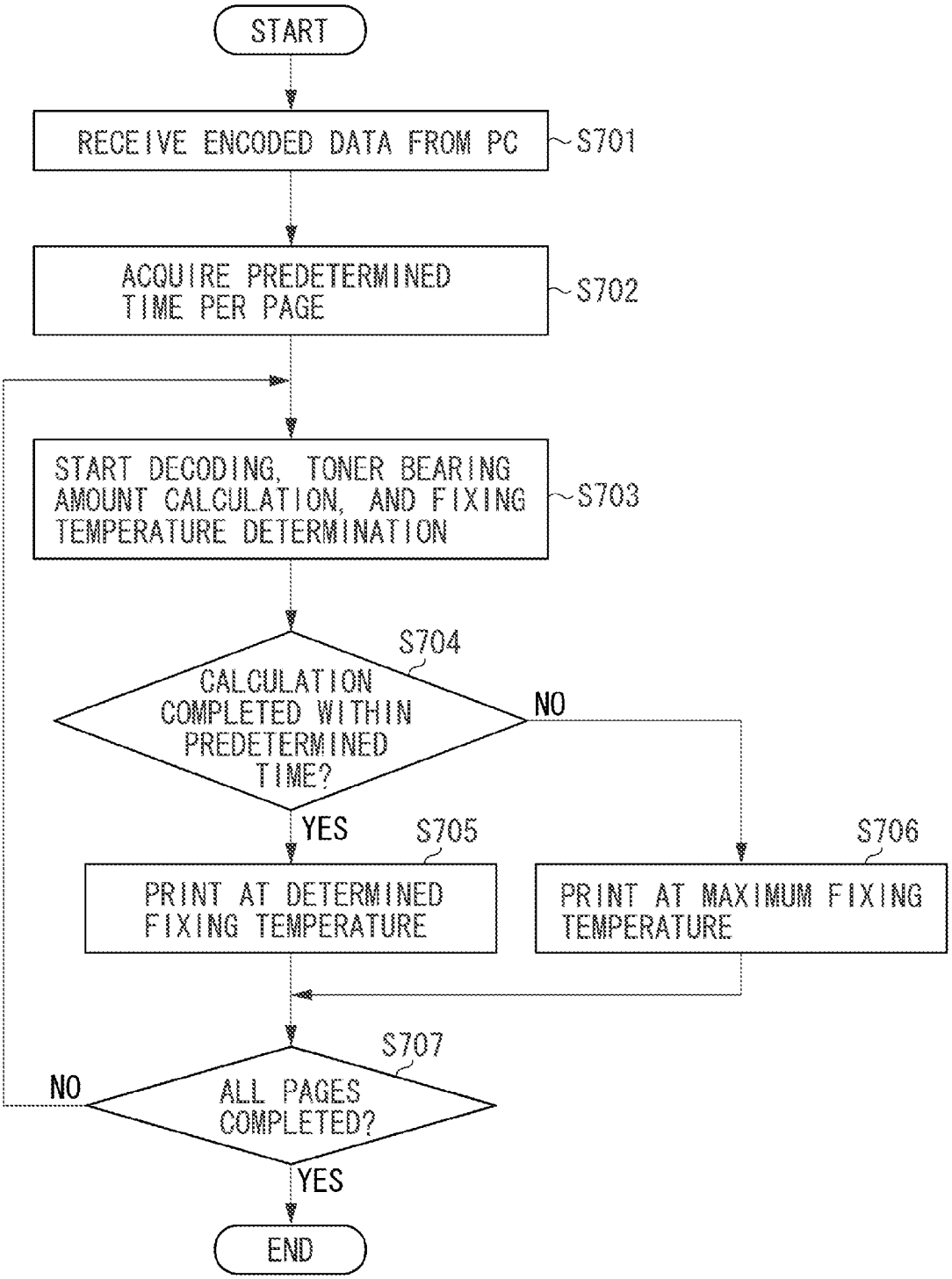
FIG. 7 is a flowchart illustrating a control flow in a print speed priority mode according to a second exemplary embodiment of the present invention.

FIG. 7 is a flowchart illustrating a control flow of the print speed priority mode according to the present exemplary embodiment. The processing in step S701 is similar to that in step S601 in the first exemplary embodiment, and its description is omitted. In step S702, the sub CPU 205 acquires a predetermined time written in the RAM 204 in advance by the CPU 202. The predetermined time is for decoding the encoded CMYK image data of one page, calculating a toner bearing amount, and determining a fixing temperature. The predetermined time is calculated in advance based on a print speed of the image forming apparatus 100, and written in the RAM 204 by the CPU 202. For example, when a print speed of the image forming apparatus 100 is 60 sheets per minute, the print time per sheet is one second, and then, a predetermined time of 0.8 second including a margin of 0.2 second is set. The predetermined time is not limited to the processing time per page and, for example, a predetermined time per unit page such as ½ page, ⅓ page, 2 pages, or 3 pages can be set.

In step S703, the sub CPU 205 starts decoding the encoded CMYK image data of a unit page, the image data including image data of a plurality of pages, calculating the toner bearing amount, and determining the fixing temperature. In this processing, the sub CPU 205 measures, with an internal counter in the CPU, the time required for the image processing including the decoding, the calculation of the toner bearing amount, and the determination of the fixing temperature. The time measurement may be performed with respect to a time required for decoding, and calculating toner bearing amount without measuring the time required for determining a fixing temperature. In the toner bearing amount calculation, a total of the toner amounts of the colors of C, M, Y, and K per unit area of the image data is calculated.

In step S704, if the determination of a fixing temperature by the sub CPU 205 has been completed within the predetermined time (YES in step S704), the processing proceeds to step S705. On the other hand, if the determination has not been completed (NO in step S704), the processing proceeds to step S706. The processing in step S705 is similar to that in step S604 in the first exemplary embodiment, and its description is omitted. In step S706, the sub CPU 205 stops decoding, calculating the toner bearing amount, and determining the fixing temperature, and sends a maximum fixing temperature to the printer unit 210. The printer unit 210 executes the fixation at the maximum fixing temperature received from the sub CPU 205. The maximum fixing temperature is a predetermined temperature enabling fixation of image data of four colors of the superimposed recording materials of C, M, Y, and K of the maximum bearing amount.

In step S707, the decoding of the encoded CMYK image data, the calculation of a toner bearing amount, and the determination of a fixing temperature of all pages is performed. If the processing has been completed (YES in step S707), the processing ends, and if not (NO in step S707), the processing proceeds to step S703, and the processing is repeated until the processing of all pages is completed.

As described above, in the print speed priority mode, a time for decoding the encoded data, calculating the toner bearing amount, and determining the fixing temperature of encoded CMYK image data of one page is provided, and if the processing is not completed within the predetermined time, the calculation processing is stopped and fixation at a maximum fixing temperature is started. This enables printing at a maximum fixing temperature without decreasing the print speed of the image forming apparatus 100. Consequently, even if the fixing temperature determination is stopped, the printing can be performed without fixation failure.

Moreover, if a temperature of the fixing device 311 after returning from a sleep state is low, it takes time to increase the temperature of the fixing device 311. Then, if the apparatus tries to calculate a fixing temperature and increase the temperature of the fixing device 311, the processing takes time and this causes the print speed to be decreased. To solve the problem, with respect to first several pages (predetermined pages), the fixing temperature determination may be omitted and the fixation may be performed at a maximum fixing temperature to prevent decreasing the print speed. In such a case, the fixing temperature calculation is performed with respect to pages after the first several pages.

A third exemplary embodiment of the present invention is described. In the first exemplary embodiment, in the energy-saving mode, for all pages, the image forming apparatus 100 calculates a toner bearing amount from image data of each page, and determines a fixing temperature to reduce the power consumption to a minimum. In the second exemplary embodiment, in the print speed priority mode, a time for decoding, calculating toner bearing amount, and determining the fixing temperature is provided, and if the processing has not completed within the predetermined time, the printing is performed at a maximum fixing temperature without decreasing the print speed in the image forming apparatus 100. In the second exemplary embodiment, however, when the fixing temperature calculation is stopped and the printing is performed at the maximum fixing temperature, to image data of a small toner bearing amount, the printing is also performed at the maximum fixing temperature. This may cause unnecessary increase in the power consumed in the heaters 314 and 315 in the fixing device 311.

In the present exemplary embodiment, operation in the image forming apparatus 100 in which the two modes of the energy-saving mode according to the first exemplary embodiment and the print speed priority mode according to the second exemplary embodiment are switched based on a preset allowable percentage is described.

Figure 8B:
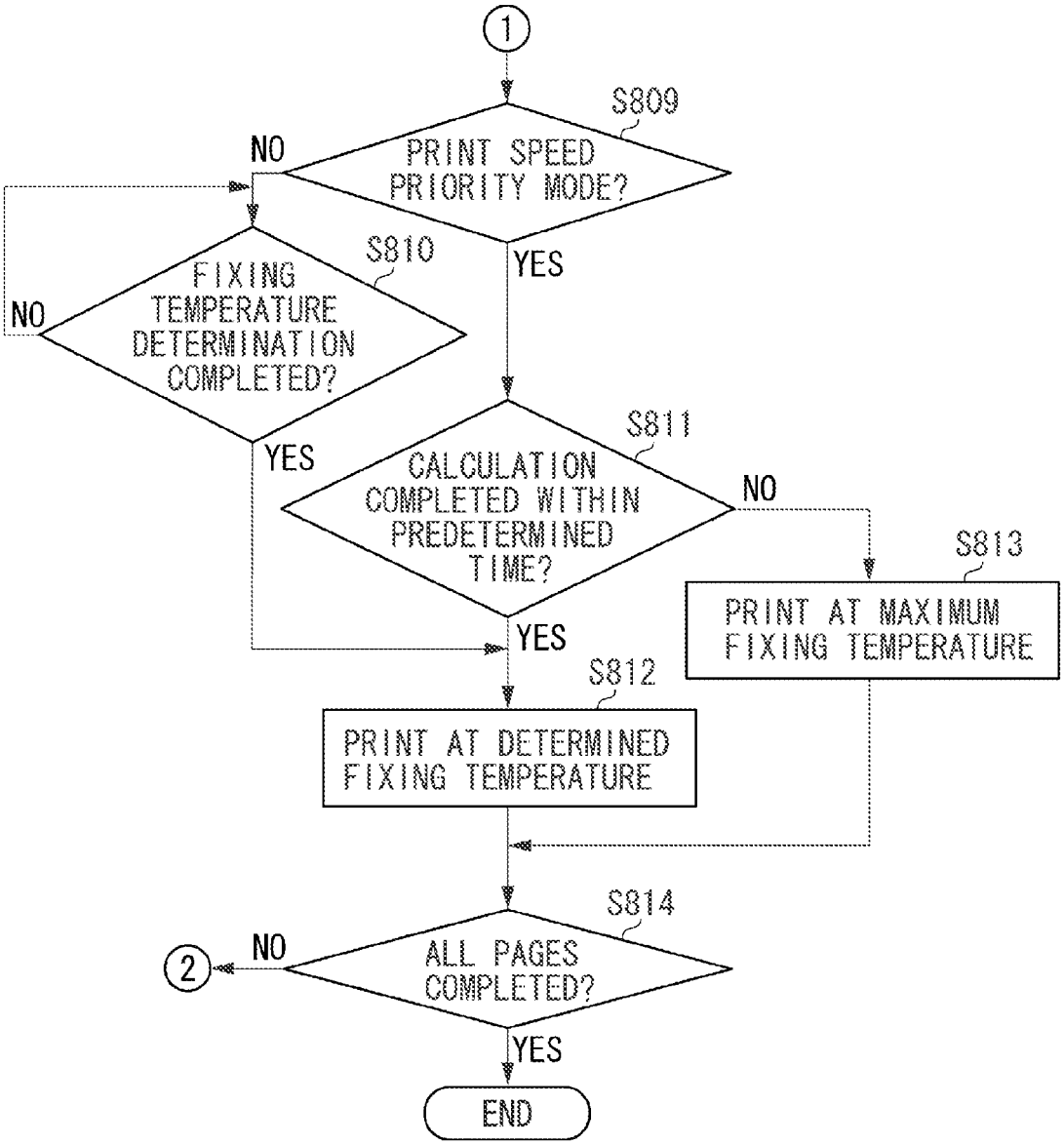
FIG. 8 (consisting of FIGS. 8A and 8B) is a flowchart illustrating a control flow of an image forming apparatus according to a third exemplary embodiment of the present invention.

FIG. 8 (consisting of FIGS. 8A and 8B) is a flowchart illustrating a control flow according to the present exemplary embodiment. The processing in step S801 is similar to that in step S601 in the first exemplary embodiment, and its description is omitted. The processing in step S802 is similar to that in step S702 in the second exemplary embodiment, and its description is omitted. In step S803, the sub CPU 205 acquires a predetermined percentage written in the RAM 204 in advance by the CPU 202. The percentage is an allowable percentage, in performing printing, for stopping decoding the encoded CMYK image data, calculating the toner bearing amount, and determining the fixing temperature described in step S706 in the second exemplary embodiment, and to print at a maximum fixing temperature. The allowable percentage is set based on a print speed of the image forming apparatus 100 and an energy-saving target. For example, when low power consumption is emphasized, the allowable percentage is set to a lower value, and when print speed is emphasized, the allowable percentage is set to a higher value. In step S804, based on the allowable percentage acquired in step S803, the number of non-energy saving allowable sheets is calculated. The number of non-energy saving allowable sheets is the number of sheets allowable, in the number of sheets to be printed, for stopping decoding the encoded CMYK image data, calculating the toner bearing amount, and determining the fixing temperature, and to print at a maximum fixing temperature. For example, if the number of sheets to be printed is 10, and the allowable percentage is set to 20% in step S803, the number of non-energy saving allowable sheets is two sheets. In step S805, if the number of cumulative non-energy saving sheets is smaller than the number of non-energy saving allowable sheets as a predetermined number (YES in step S805), the processing proceeds to step S806, and if the number of cumulative non-energy saving sheets is larger than or equal to the predetermined number (NO in step S805), the processing proceeds to step S807. In step S806, the sub CPU 205 enters the print speed priority mode described in the second exemplary embodiment. In step S807, the sub CPU 205 enters the energy-saving mode described in the first exemplary embodiment. The number of cumulative non-energy saving sheets is counted after each completion of the processing in step S813 described below by a counter (not illustrated) in the image forming apparatus 100. Alternatively, the number of cumulative non-energy saving sheets is counted at the timing at which it is determined to perform printing at the maximum fixing temperature.

The processing in step S808 is similar to that in step S602 in the first exemplary embodiment, and its description is omitted. In step S809, if the mode is the energy-saving mode (NO in step S809), the processing proceeds to step S810, and if the mode is the print speed priority mode (YES in step S809), the processing proceeds to step S811. In step S810, regardless of the predetermined time acquired in step S802, the sub CPU 205 performs decoding the encoded CMYK image data, calculating the toner bearing amount, and determining the fixing temperature until the processing is completed, and when the processing is completed (YES in step S810), the processing proceeds to step S812.

In step S811, if the decoding of the encoded CMYK image data, the calculation of a toner bearing amount, and the fixing temperature determination have been completed within the predetermined time acquired in step S802 (YES in step S811), the processing proceeds to step S812. If the processing has not been completed within the predetermined time (NO in step S811), the processing proceeds to step S813. The processing in step S812 is similar to that in step S604 in the first exemplary embodiment, and its description is omitted. The processing in step S813 is similar to that in step S706 in the second exemplary embodiment, and its description is omitted. In step S814, if the decoding of the encoded CMYK image data, the calculation of a toner bearing amount, and the determination of a fixing temperature of all pages have been completed (YES in step S814), the processing ends. If the processing has not been completed (NO in step S814), the processing proceeds to step S805, and the processing is repeated until the processing of all pages is completed.

In the third exemplary embodiment, a allowable percentage for printing at a maximum fixing temperature is set, and based on the percentage, a fixing temperature is determined. This enables reduction in the power consumption in the image forming apparatus 100 while preventing decrease in the print speed of the image forming apparatus 100.

A fourth exemplary embodiment of the present invention is described. In the third exemplary embodiment, based on a print speed of the image forming apparatus 100 and an energy-saving target, an allowable percentage is set in advance in the RAM 204. In the present exemplary embodiment, the allowable percentage can be selected by a user instead of setting the allowable percentage in advance. Ten, the control flow of the image forming apparatus 100 is described.

Figures 9, 9A:
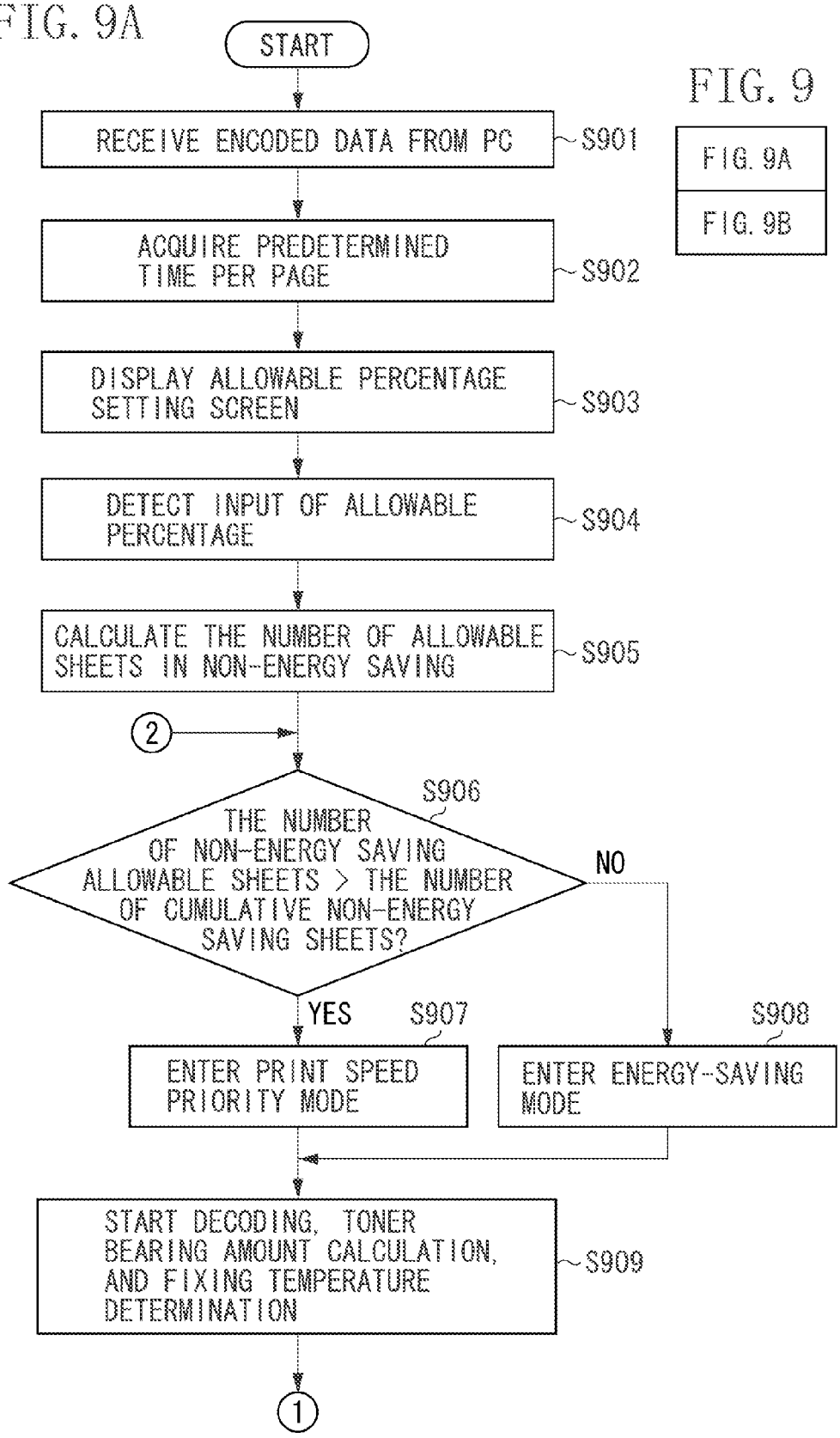
FIG. 9 (consisting of FIGS. 9A and 9B) is a flowchart illustrating a control flow of an image forming apparatus according to a fourth exemplary embodiment of the present invention.
Figure 9B:
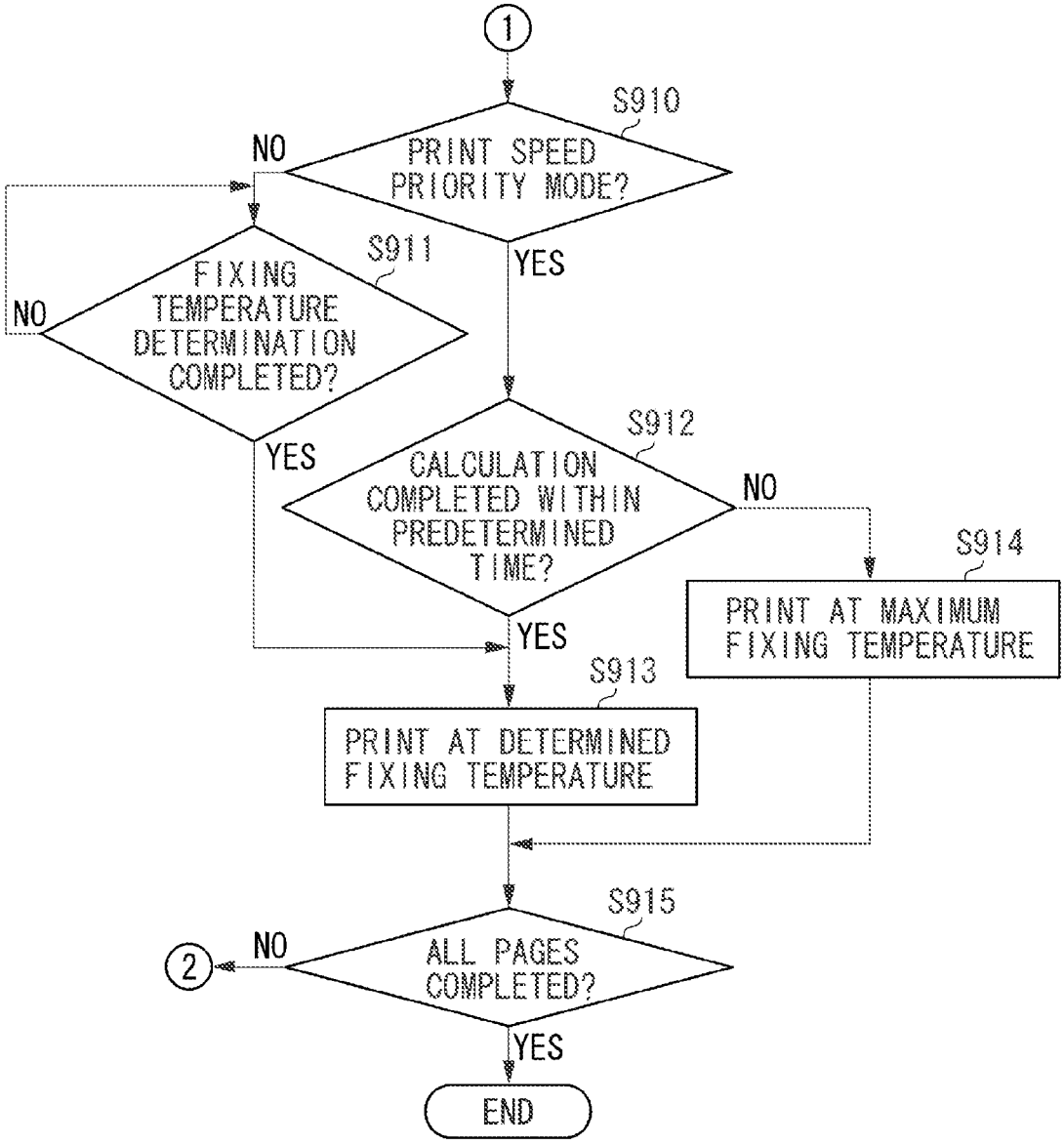
Figure 10:
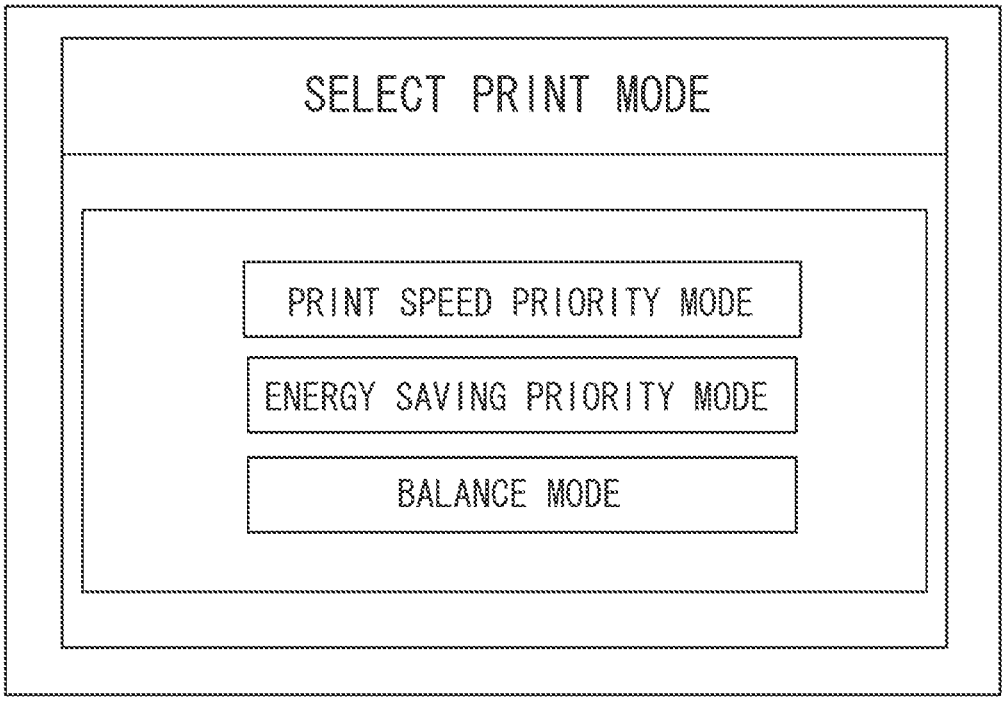
FIG. 10 illustrates an image displayed on a display unit according to the fourth exemplary embodiment of the present invention.
Figure 11:
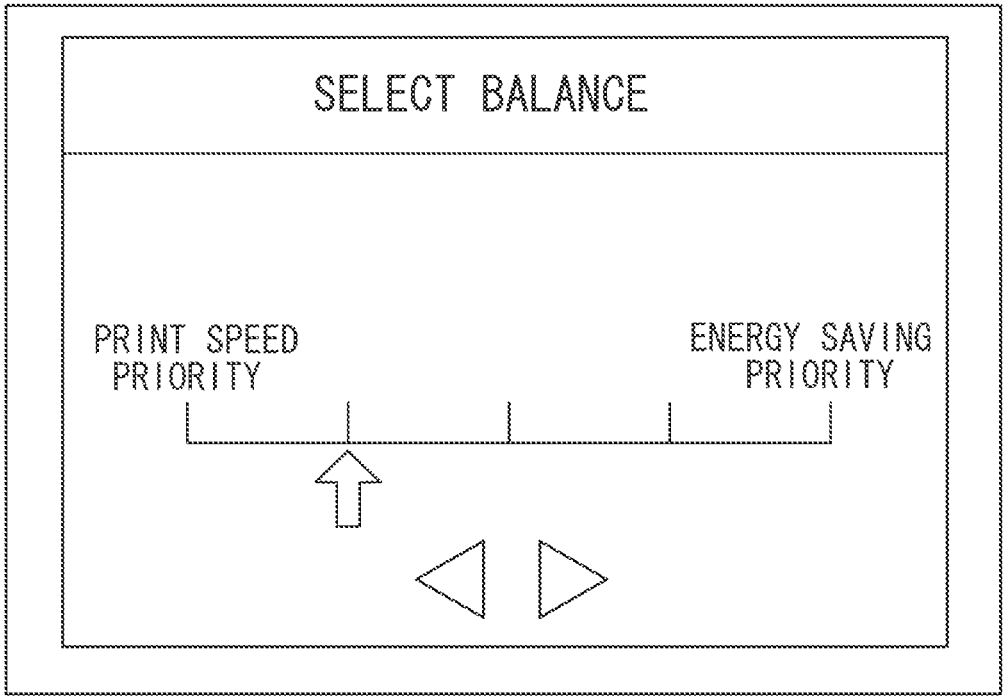
FIG. 11 illustrates an image displayed on the display unit according to the fourth exemplary embodiment of the present invention.

FIG. 9 (consisting of FIGS. 9A and 9B) is a flowchart illustrating a control flow of the image forming apparatus 100 in which an allowable percentage can be set by a user. The processing in steps S901 and 902 are similar to that in steps S701 and S702 in the second exemplary embodiment, and its description is omitted. In step S903, the CPU 202 displays, on the display unit 207, a user interface (UI) that prompts a user to enter an allowable percentage like the display illustrated in FIG. 10. In step S904, the CPU 202 detects an input from the user on the operation unit 206. At that time, when the CPU 202 detects an input of the print speed priority mode, the CPU 202 determines that the allowable percentage is 100%, and when the CPU 202 detects an input of the energy-saving mode, the CPU 202 determines that the allowable percentage is 0%, and writes the value in the RAM 204. When the CPU 202 detects an input of the balance mode, the CPU 202 displays, on the display unit 207, a UI that prompts the user to enter a print speed, and a degree of priority of energy saving as illustrated in FIG. 11. Then, the CPU 202 detects the instruction input by the user on the operation unit 206, and based on the selection, the CPU 202 writes an allowable percentage in the RAM 204. The processing after step S905 is similar to that in the third exemplary embodiment, and its description is omitted.

As described above, a user can select an allowable percentage to select which of the print speed and the energy saving is to be prioritized.

A fifth exemplary embodiment of the present invention is described. In the second exemplary embodiment, the third exemplary embodiment, and the fourth exemplary embodiment, in the print speed priority mode, for each page unit, a predetermined time is provided for decoding the encoded CMYK image data, calculating the toner bearing amount, and determining the fixing temperature. In the present exemplary embodiment, a plurality of predetermined times defined not per page unit, but per unit smaller than the page unit are provided. With this configuration, the image forming apparatus 100 can stop decoding, calculating the toner bearing amount, and determining the fixing temperature in less time, and determine whether to execute printing at a maximum fixing temperature. The image forming apparatus 100 including such a configuration is described.

Figure 12:
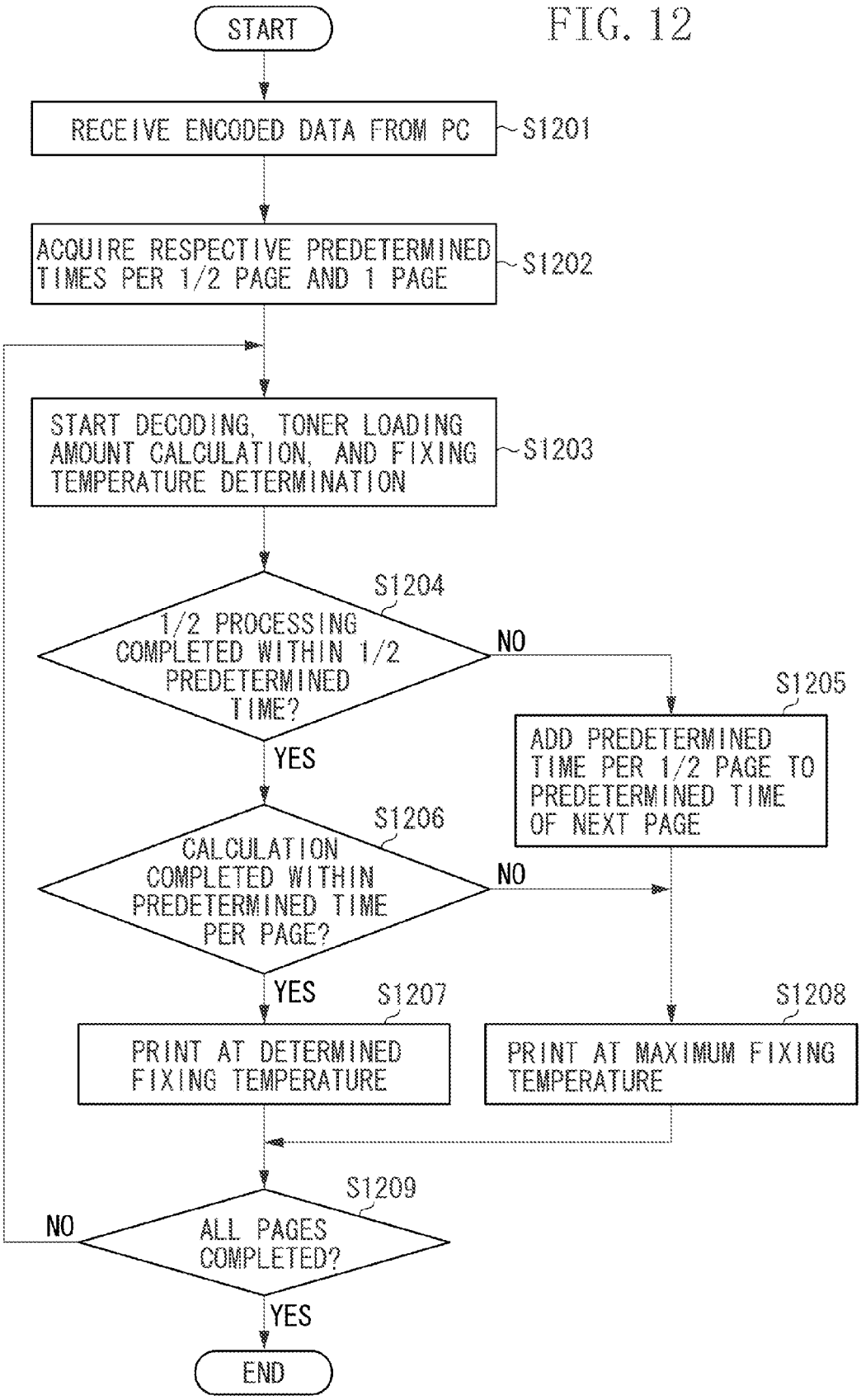
FIG. 12 is a flowchart illustrating a control flow of an image forming apparatus according to a fifth exemplary embodiment of the present invention.

FIG. 12 is a flowchart illustrating a control flow of the image forming apparatus 100 according to the present exemplary embodiment. The processing in step S1201 is similar to that in step S701 in the second exemplary embodiment, and its description is omitted. In step S1202, the sub CPU 205 acquires a predetermined time per page and a predetermined time per ½ page written in the RAM 204 in advance. The predetermined time per ½ page is half the predetermined time per page. The processing in step S1203 is similar to that in step S703 in the second exemplary embodiment, and its description is omitted. In step S1204, the sub CPU 205 determines whether more than half of the decoding of encoded CMYK image data and the toner bearing amount calculation has been completed within the predetermined time per ½ page. If the processing has been completed (YES in step S1204), the processing proceeds to step S1206, and if the processing has not been completed (NO in step S1204), the processing proceeds to step S1205. As described in the first exemplary embodiment, the time necessary for determining the fixing temperature based on the look-up table in the RAM 204, and the processing requires very little time, and consequently, the time is not considered.

In step S1205, the sub CPU 205 adds the predetermined time per ½ page written in the RAM 204 by the CPU 202 to the predetermined time per page only in the processing of the next page. The predetermined time to be added is not limited to the predetermined time per ½ page, but a predetermine time can be added. FIG. 13 illustrates predetermined times per page and per ½ page when the predetermined time per page written in the RAM 204 in step S1202 by the CPU 202 is 0.8 second. The processing after step S1206 is similar to that in the second exemplary embodiment, and its description is omitted.

As described above, the additional setting of the time per ½ enables, with time shorter than the time necessary in the print speed priority mode in the second exemplary embodiment, to stop decoding the encoded data, calculating the toner bearing amount, and determining the fixing temperature of the page, and to execute the printing at a maximum fixing temperature. This enables the image forming apparatus to provide a longer predetermined time for the next page, and the fixing temperature calculation processing can be performed for more pages while maintaining the print speed. While only the predetermined time per ½ page is additionally set in the present exemplary embodiment, more predetermined times can be added. For example, with a predetermined time per ⅓, a processing time per ⅓ can be determined, or with a predetermined time per ¼, a processing time per ¼ can be determined.

A sixth exemplary embodiment of the present invention is described. In the second and fifth exemplary embodiments, in the print speed priority mode, a time period for decoding the encoded CMYK image data, calculating the toner bearing amount, and determining the fixing temperature is provided, and if the processing is not completed within the predetermined time, the calculation processing is stopped, and fixation at a maximum fixing temperature is started. The processing time depends on the contents of the encoded CMYK data, and among them, the size of the encoded CMYK image data is the most influential factor, and as the size increases, the process time necessary for the decoding tends to increase.

In the present exemplary embodiment, the image forming apparatus 100 that determines whether to perform the decoding, the toner bearing amount calculation, and the fixing temperature determination based on a size of encoded CMYK image data is described.

Figure 14:
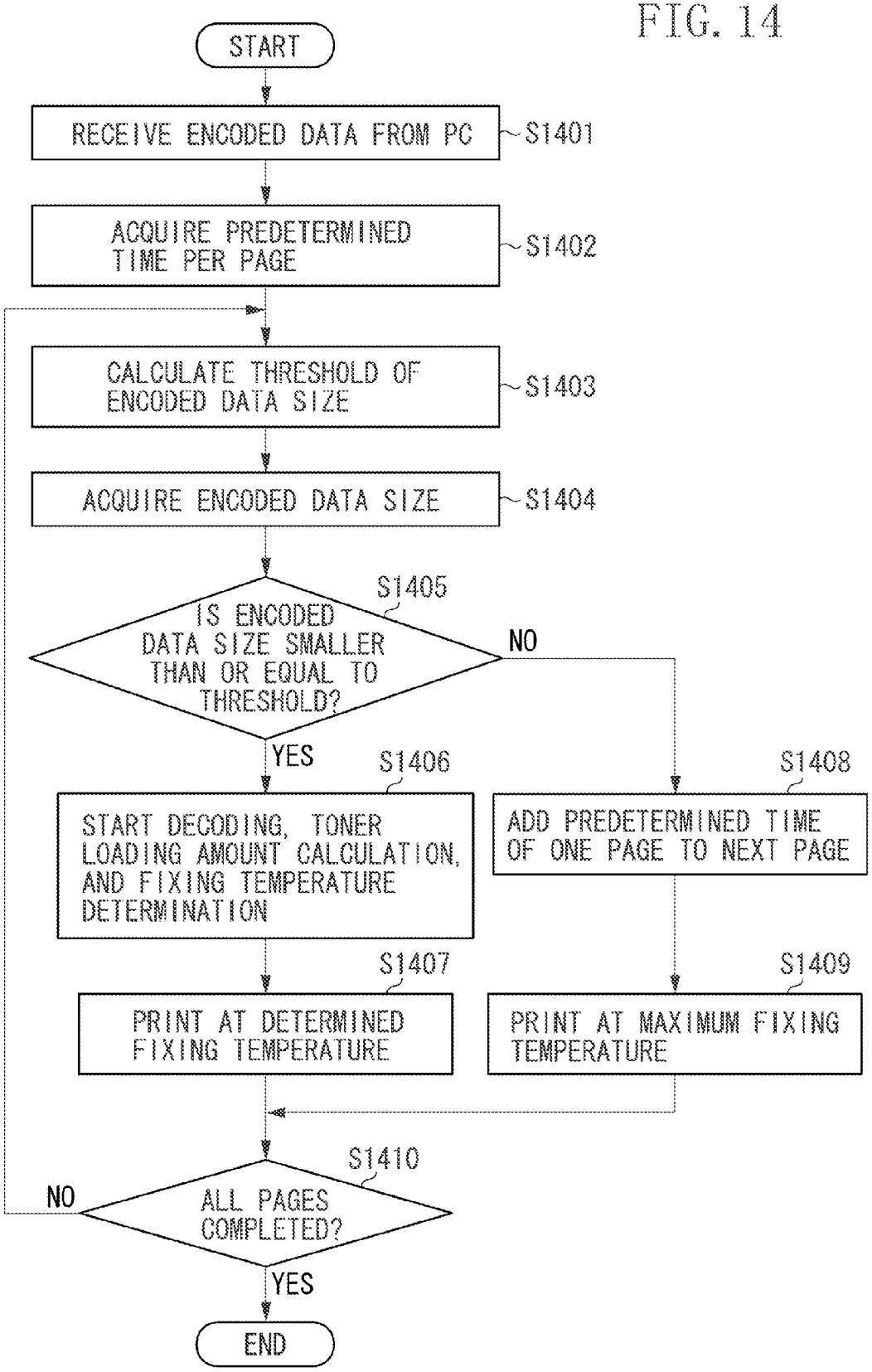
FIG. 14 is a flowchart illustrating a control flow of an image forming apparatus according to a sixth exemplary embodiment of the present invention.

FIG. 14 is a flowchart illustrating a control flow of the image forming apparatus 100 according to the present exemplary embodiment. The processing performed in steps S1401 and 1402 are similar to that performed in steps S701 and S702 in the second exemplary embodiment, and therefore its description is omitted.

In step S1403, the sub CPU 205 calculates a threshold of a encoded CMYK image data size with which the decoding, the toner bearing amount calculation, and the fixing temperature determination can be completed within the predetermined time per page acquired in step S1402. FIG. 15 illustrates an example of the thresholds of encoded CMYK image data size when the predetermined time per page acquired in step S1402 is 0.8 second and 1.2 seconds.

In step S1404, the CPU 202 calculates an encoded CMYK image data size from the encoded CMYK image data written in the RAM 204 in step S1401, and writes the encoded CMYK image data size in the RAM 204. The sub CPU 205 acquires the size of the encoded CMYK image data written in the RAM 204 by the CPU 205. In step S1405, the sub CPU 205 determines whether the encoded CMYK image data size acquired in step S1404 is smaller than or equal to the threshold calculated in step S1403. If the sub CPU 205 determines that the encoded data size is smaller than or equal to the threshold (YES in step S1405), the processing proceeds to step S1406. If the sub CPU 205 determines that the encoded data size is larger than the threshold (NO in step S1405), the processing proceeds to step S1408. The processing in steps S1406 and 1407 are similar to that in steps S703 and S705 in the second exemplary embodiment, and therefore the description thereof is omitted. In step S1408, the sub CPU 205 adds the predetermined time per page written in the RAM 204 by the CPU 202 to the predetermined time per page in the processing of the next page. The predetermined time to be added is not limited to the predetermined time per page, but a predetermine time can be added. The processing in step S1408 is similar to that performed in step S1205 in the fifth exemplary embodiment, and further description is omitted. The processing in steps S1409 and 1410 are similar to that performed in steps S706 and S707 in the second exemplary embodiment, and its description is omitted.

As described above, when the size of the encoded CMYK image data is greater than or equal to a threshold calculated from a predetermined time, without performing the decoding, the toner bearing amount calculation, and the fixing temperature determination processing, the data is fixed at a maximum fixing temperature to be printed. This enables the image forming apparatus to provide a longer predetermined time for the next page, and the fixing temperature calculation processing can be performed for more pages while the print speed is maintained.

A seventh exemplary embodiment of the present invention is described. In the sixth exemplary embodiment, a threshold is calculated from a predetermined time per page, and when an encoded CMYK image data size is greater than or equal to the threshold, the decoding, the toner bearing amount calculation, and the fixing temperature determination is not performed, and printing is performed at a maximum fixing temperature.

In the present exemplary embodiment, a determined fixing temperature result is not sent to the printer unit 210, and spooled in the RAM 204. Then, according to a print speed, the CPU 202 sends the result to the printer unit 210. This enables the image forming apparatus to perform the decoding, the toner bearing amount calculation, and the fixing temperature determination prior to the print processing.

Figure 16:
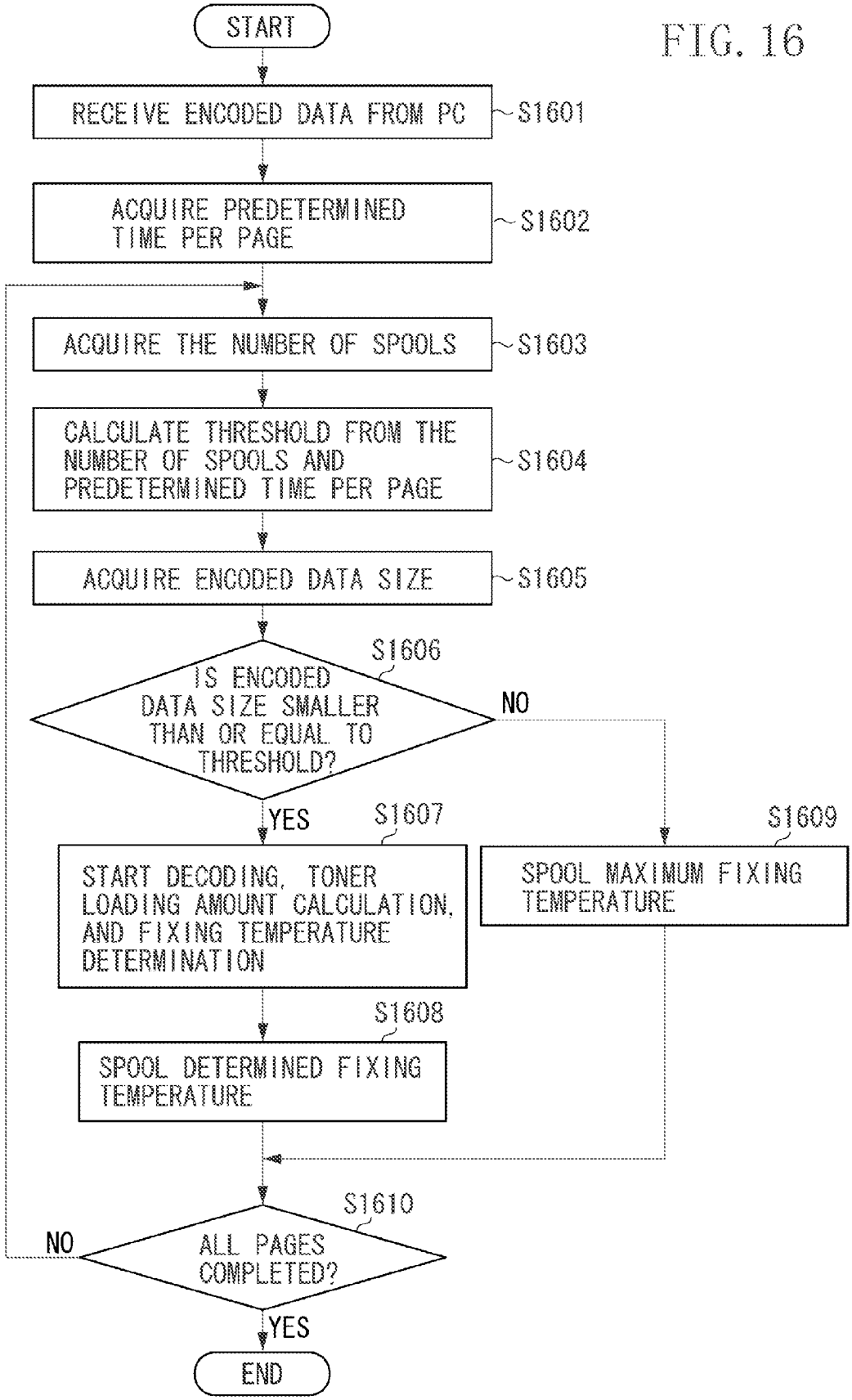
FIG. 16 is a flowchart illustrating a control flow of an image forming apparatus according to a seventh exemplary embodiment of the present invention.

FIG. 16 is a flowchart illustrating a control flow of the image forming apparatus 100 according to the present exemplary embodiment. The processing in steps S1601 and 1602 are similar to that in steps S1401 and S1402 in the sixth exemplary embodiment, and therefore its description is omitted.

In step S1603, the sub CPU 205 acquires the number of determined fixing temperature results (hereinafter, referred to as the number of spools) that is spooled in the RAM 204. When encoded CMYK image data is of the first page, the number of spools is zero. When the decoding, the toner bearing amount calculation, and the fixing temperature determination processing is performed at a speed faster than the print speed, the number of spools increases as 1, 2, and 3.

In step S1604, the sub CPU 205 calculates a threshold from the predetermined time per page acquired in step S1602, and the number of spools acquired in step S1603. FIG. 17 is a table illustrating an example of thresholds of the encoded CMYK image data when predetermined times per page are 0.8 second and 1.2 seconds, and the number of spools is 0, 1, and 2. The processing from steps S1605 to step S1607 are similar to that from steps S1404 and S1406 in the sixth exemplary embodiment, and therefore its description is omitted. In step S1608, the sub CPU 205 writes the fixing temperature determined in step S1607 into the RAM 204. In this processing, the number of spools increases by one. In step S1609, the sub CPU 205 writes a maximum fixing temperature into the RAM 204. In this processing, the number of spools increases by one. The processing performed in step S1610 is similar to that performed in step S1410 in the sixth exemplary embodiment, and therefore its description is omitted.

Although not illustrated in FIG. 16, a spooled determined fixing temperature result is sent to the printer unit 210 by the CPU 202 according to a print speed. In this processing, the number of spools decreases by one.

As described above, a determined fixing temperature result is spooled in the RAM 204, and the decoding, the toner bearing amount calculation, and the fixing temperature determination are performed prior to the print processing to set a larger threshold of an encoded CMYK image data size of pages after the next page. This enables the image forming apparatus to perform the fixing temperature calculation processing for more pages after the next page while the print speed is maintained.

An aspect of the present invention can be implemented by executing the following processing. Specifically, software (program) to implement the functions of the above-described exemplary embodiments is supplied to a system or apparatus via a network or various types of storage media. A computer, (or a CPU, or a micro processing unit (MPU)) of the system or apparatus reads out and executes the program.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application 2013-240033 filed Nov. 20, 2013, and No.

2014-151197 filed Jul. 24, 2014, which are hereby incorporated by reference herein in their entirety.

What is claimed is:

1. An image forming apparatus comprising:

a receiving unit configured to receive a page of image data;

an image forming unit configured to form a toner image on a photosensitive member based on the page of image data received by the receiving unit;

a transfer unit configured to transfer the toner image formed by the image forming unit onto a sheet;

a fixing unit configured to fix the toner image transferred by the transfer unit onto the sheet; and a control unit configured to decode the page of image data received by the receiving unit and determine a temperature for fixing the toner image on the sheet;

wherein in a case where the decoding of the page of image data is completed within a predetermine time from when starting the decoding of the page of image data, the control unit controls the fixing unit so that the temperature to be a first temperature determined from a result of the decoding the page of image data, wherein in a case where the decoding of the page of image data is not completed within the predetermined time, the control unit controls the fixing unit so that the temperature to be a second temperature determined regardless of a result of decoding of the page of image data.

2. The image forming apparatus according to claim 1, wherein the image forming apparatus has a print speed priority mode in which a print speed is given with priority, and an energy-saving mode in which a power-saving is given with priority, wherein, in the print speed priority mode, the control unit controls the fixing unit so that the temperature to be the second temperature in a case where the decoding of the page of image data is not completed within the predetermined time, wherein, in the energy-saving mode, the control unit controls the fixing unit so that the temperature to be the first temperature even if the predetermined time elapse.

3. The image forming apparatus according to claim 1, wherein the control unit is configured to calculate a toner bearing amount and then determine a temperature of the fixing unit based on the result of calculating the toner bearing amount.

4. The image forming apparatus according to claim 3, wherein the toner bearing amount is a total of amounts of toners of Cyan, Magenta, Yellow, and Black per unit area of the image data.

5. The image forming apparatus according to claim 1, wherein the second temperature is a temperature at which toner of Cyan, Magenta, Yellow, and Black of a maximum application amount can be fixed.

6. An image forming apparatus comprising:

a receiving unit configured to receive a page of image data;

an image forming unit configured to form a toner image on a photosensitive member based on the page of image data received by the receiving unit;

a fixing unit configured to fix the toner image transferred by the transfer unit onto the sheet;

a fixing unit configured to fix the toner image onto the sheet; and a control unit configured to decode the page of image data received by the receiving unit and determine a temperature for fixing the toner image on the sheet, wherein the control unit obtains a data size of the page of image data, wherein in a case where the data size does not exceed an allowable size, the control unit controls the fixing unit so that the temperature to be a first temperature determined from a result of the decoding of the page of image data, wherein in a case where the data size being obtained exceeds the allowable size, the control unit controls the fixing unit so that the temperature to be a second temperature determined regardless of a result of decoding of the page of image data.

7. The image forming apparatus according to claim 6, wherein the control unit is configured to calculate a toner bearing amount from the page of image data received by the receiving unit and then determine a temperature of the fixing unit based on a result of calculating the toner bearing amount.

8. An image forming apparatus comprising:

an image forming unit configured to form an image on a sheet based on a page of image data;

a fixing unit configured to fix the image formed by the image forming unit onto the sheet; and a control unit configured to analyze the page of the image data so as to determine a temperature for fixing the toner image on the sheet;

wherein, in a case where the analysis of the page of image data is completed within a predetermine time, the control unit controls the fixing unit so that the temperature to be a first temperature determined from a result of the analysis of the page of image data, wherein, in a case where the analysis of the page of image data is not completed within the predetermined time, the control unit controls the fixing unit so that the temperature to be a second temperature determined regardless of a result of the analysis of the page of image data.

9. The image forming apparatus according to claim 8, wherein the image forming unit comprising:

a photosensitive member;

an exposure unit configured to emit light toward the photosensitive member so as to form an electrostatic latent image based on the page of the image data;

a development unit configured to develop, with toner, the electrostatic latent image that is formed by the exposure unit so as to form a toner image on the photosensitive member; and a transfer unit configured to transfer the toner image onto the sheet, wherein the fixing unit is configured to fix the toner image transferred by the transfer unit onto the sheet, the toner image corresponding to the page of the image data.

10. The image forming apparatus according to claim 8, further comprising a receiving unit configured to receive the page of image data from a computer over a network.

11. The image forming apparatus according to claim 8, wherein the control unit is configured to decode the page of the image data and then analyze the page of image data which has been decoded.

12. The image forming apparatus according to claim 11, wherein the control unit is configured to determine the temperature regardless of the analysis of the page of the image data in a case where the analysis of the page of the image data is not completed within a time period when starting the analysis of the page of the image data.

13. The image forming apparatus according to claim 8, wherein the control unit is configured to calculate toner bearing amount information corresponding to the page of the image data based on the analysis of the page of the image data, where the temperature for the page of the image data is determined based on the calculated toner bearing amount.

14. The image forming apparatus according to claim 8, wherein the first temperature is a fixing temperature corresponding to a toner bearing amount information per page.

15. The image forming apparatus according to claim 8, wherein the second temperature is a maximum fixing temperature.

16. An image forming apparatus comprising:

an image forming unit configured to form an image on a sheet based on a page of image data;

a fixing unit configured to fix the image formed by the image forming unit onto the sheet; and a control unit configured to (i) analyze the page of image data to determine a temperature for fixing the image on the sheet and (ii) control the fixing unit to fix the image onto the sheet based on the determined temperature, wherein the control unit is configured to, in a case where the analysis of the page of the image data is not completed at a time limit, stop the analysis of the page of the image data and determine a predetermined target temperature for fixing the image on the sheet.

17. An image forming apparatus comprising:

a receiving unit configured to receive a plurality of pages of image data;

an image forming unit configured to form an image on a sheet based on a target page of the plurality of pages of the image data;

a fixing unit configured to fix the image formed by the image forming unit onto the sheet; and a control unit configured to (i) analyze the target page of image data to determine a fixing temperature for fixing the image on the sheet and (ii) control the fixing unit to fix the image onto the sheet based on the determined temperature, wherein the control unit is configured to determine a predetermined temperature with respect to first several pages of the plurality of pages of image data received by the receiving unit, the predetermined temperature being determined regardless of analysis by the control unit.

18. The image forming apparatus according to claim 17, wherein the image forming unit comprising:

a photosensitive member;

an exposure unit configured to emit light toward the photosensitive member so as to form an electrostatic latent image based on the target page of the image data;

a development unit configured to develop, with toner, the electrostatic latent image that is formed by the exposure unit so as to form a toner image on the photosensitive member; and a transfer unit configured to transfer the toner image onto the sheet, wherein the fixing unit is configured to fix the toner image transferred by the transfer unit onto the sheet, the toner image corresponding to the target page of the image data.

19. The image forming apparatus according to claim 17, wherein the plurality of pages of image data are received from a client computer.

20. The image forming apparatus according to claim 17, wherein the control unit is configured to decode the target page of image data and then analyze the target page of image data which has been decoded.

21. The image forming apparatus according to claim 17, wherein the control unit is configured to determine the predetermined temperature regardless of the analysis of the target page of the image data in a case where the analysis of the target page of the image data is not completed within a time period.

22. The image forming apparatus according to claim 17, wherein the control unit is configured to calculate toner bearing amount information corresponding to the target page of the image data based on the analysis of the target page of the image data, wherein the control unit is configured to determine the temperature for fixing the image on the sheet based on the calculated toner bearing amount.

23. The image forming apparatus according to claim 17, wherein the predetermined temperature is a fixing temperature corresponding to a toner bearing amount information per page.

24. The image forming apparatus according to claim 17, wherein fixing temperature determination is not performed with respect to the first several pages and is performed with respect to pages after the first several pages.

25. The image forming apparatus according to claim 17, wherein the predetermined temperature is a maximum fixing temperature.

* * * * *